US007195193B2

(12) United States Patent
Capps

(10) Patent No.: US 7,195,193 B2
(45) Date of Patent: Mar. 27, 2007

(54) FENCE MASTER FENCING DISPENSER AND TENSIONING DEVICE

(76) Inventor: Michael John Capps, P.O. Box 596, 52 Lane 16, Cody, WY (US) 82414

( * ) Notice: Subject to any disclaimer, the term of this patent is extended or adjusted under 35 U.S.C. 154(b) by 19 days.

(21) Appl. No.: 10/905,009

(22) Filed: Dec. 9, 2004

(65) Prior Publication Data

US 2005/0133776 A1 Jun. 23, 2005

Related U.S. Application Data

(60) Provisional application No. 60/528,195, filed on Dec. 10, 2003.

(51) Int. Cl.
*B65H 59/24* (2006.01)
*B65H 75/30* (2006.01)
*B65H 27/00* (2006.01)

(52) U.S. Cl. ..... 242/396.5; 242/403; 242/557; 242/598.5

(58) Field of Classification Search ..... 256/37, 256/40–42; 242/125.2, 396.5, 396.6, 403, 242/557, 598.5; 254/228, 323, 378
See application file for complete search history.

(56) References Cited

U.S. PATENT DOCUMENTS 2,914,270 A 11/1959 Parker
3,048,348 A * 8/1962 Griffin ..... 242/422.5
3,104,863 A 9/1963 De Forest
3,570,731 A * 3/1971 Waltz ..... 225/38
3,650,492 A * 3/1972 Stum ..... 242/390
3,722,861 A 3/1973 Anderson
3,937,414 A * 2/1976 Bank et al. ..... 242/557
4,775,114 A * 10/1988 Farnsworth ..... 242/422.8
4,854,521 A 8/1989 Farnsworth
4,930,718 A 6/1990 Lancour et al.
5,042,737 A * 8/1991 Sigle et al. ..... 242/423.1
5,568,900 A * 10/1996 Conroy ..... 242/557
5,632,470 A 5/1997 Leland
5,806,779 A * 9/1998 Crum ..... 242/399.1
6,360,984 B1 * 3/2002 England ..... 242/557

* cited by examiner

*Primary Examiner*—Daniel P. Stodola
*Assistant Examiner*—Joshua T. Kennedy
(74) *Attorney, Agent, or Firm*—Kunzler & McKenzie

(57) ABSTRACT

An apparatus and method of unrolling and stretching fence wire for use with a vehicle is disclosed. This device is designed to aid in the installation of fencing such as woven, barb or welded wire and other types of roll fencing. The device stretches fencing against the preset posts as it is spooling the fencing material by applying constant tension on the dispensed fencing. This device allows the installer to attach the fence to the posts without loosing tension and having to re-stretch the fence before permanently attaching it. The fencing material is guided through the tensioning rollers that apply pressure onto the fencing material. The tensioning rollers are adjustable and tension is applied to the wire by a brake mechanism. The device holds four rolls of fencing wire and allows for continuous fencing by splicing a new roll to the end of another before going through the tensioning rollers.

14 Claims, 6 Drawing Sheets

FENCE MASTER FENCING DISPENSER AND TENSIONING DEVICE

CROSS REFERENCE TO RELATED APPLICATIONS

This application claims the benefit of PPA No. 60/528,195, filed Dec. 10, 2003 by the present inventor.

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

The field of the invention is devices for constructing farm or highway fencing including woven wire, chain link and/or barbed wire attached to posts spaced as may be required. More particularly the field is devices for unwinding fencing wire rolls and tensioning said wire properly for attachment to the posts.

State of the Art usually consists of unrolling fencing wire on the ground along a fence line of preset posts. The wire is then attached to a properly braced fence post and a limited length is stretched along the other posts and attached to said posts. The fence is manually stretched by clamping the free end of the wire and pulling on the clamp by means of a vehicle, block and tackle, come-a-long or some type of lever device. There are a small number of devices that spool the wire along the post line in a vertical configuration for attachment to the preset fence posts. Most of these require a separate operation to stretch the wire properly before attachment to the posts. U.S. Pat. No. 2,914,270 discloses a vertically mounted woven wire dispenser that carries a single roll of wire. It is used to dispense wire vertically but uses a manually operated hydraulic valve to clamp the wire and stretches the wire by moving the carrying vehicle in a separate operation. This method can result in distorted wire and is time consuming. U.S. Pat. No. 4,854,521 discloses a fence wire dispensing and stretching device that applies pressure to the top and bottom of a roll of wire that would appear to lose some of its frictional effect upon the roll of wire when nearing the end of the roll or possibly distort the roll of wire. There are indications that this device is lacking in adequate positive tensioning power. This device also requires a separate and expensive hydraulic cylinder to put enough pressure on the wire in order to hold the end of the roll from passing through the guide rollers before the next roll of wire is spliced on to continue the spooling operation. Other disadvantages are the expense of constructing the said device and that it does lose it tensioning of the wire when the vehicle is stopped. In addition to the previous disadvantages it has a large number of moving parts and the wear on the compression plates at the top and bottom of the wire rolls will wear excessively. U.S. Pat. No. 4,930,718 discloses a device for dispensing woven wire but does not provide for the stretching of the wire on the posts. U.S. Pat. No. 5,632,470 discloses a device to dispense barbed wire and using hydraulic pistons on individual stands of wire. This would be very time consuming when building long fences. U.S. Pat. No. 3,104,863 discloses a device to spool and stretch wire along fence posts. However the stretching of the wire is a separate operation which requires the stopping of the spooling operation. This is more time consuming to operate and embodies expensive parts to construct. U.S. Pat. No. 3,722,861 discloses a very complicated and expensive to build device that uses hydraulic power on a brake drum to tension the fencing wire as it is dispensed. This device could be difficult to use on varied terrain and depends on metal forks to hold the wire that may that may cause distortion in the wire fabric. It would also require the on spooling of wire to reload the spooling device and carries only the one roll.

BRIEF SUMMARY OF THE INVENTION

With the foregoing in mind, the disadvantages in the prior art are eliminated by providing an inventive device that provides constant tension on the wire of strand, woven, welded or chain link fencing as it moves along the fence line as well as when it is stopped. The tensioning force applied to the tensioning rollers by this system is so strong as to be able to prevent the carrying vehicle from moving ahead if adjusted to tightly. Advantages of this constant tension on the wire is that a new spool of wire can be splice to the previously dispensed wire to continue the operation with out any additional clamping or other means what ever to hold the tension on the wire. The constant tensioning also allows for the fencing to be rapidly dispensed and attached to approximately ever fourth preset post without any distortion of the position of the post from the pull of previously attached fencing. As shown in the illustrated drawings, the fencing application device is most useable when carried by a vehicle with a pallet fork attachment such as a farm or industrial tractor. However, the Bobcat is the vehicle of choice by the inventor.

The ability of the said fencing device to be carried by a vehicle with the pallet fork attachment is that it travels in either direction or forward and backward as the situation might require. Provision of the pallet fork type carriage enables the quick engagement or disengagement from the fencing device and the reloading of the rolls of fencing as well as moving other materials as might be desirous. Another advantage of the pallet fork type of carriage is the ability to smoothly and quickly adjust the vertical height of the dispensed wire even where it needs to be several feet high as when driving along an embankment where the fence is at the top of the embankment or on uneven ground.

The said device does not require hydraulic, power take-off or any other external power source. There are three possible adjustments for the amount of tension to apply to the fencing and these seldom require additional adjustment once set. There is one adjustment for the chain that connects the tensioning drums. The two tensioning drums and the one guide roller are coated with a resilient material to increase friction and to prevent damage to the fencing material. A brake drum is employed to the stationary tensioning drum to provide resistance to the spooling of the wire. Two compression coil springs are employed on the adjustable tensioning drum to secure the fencing between the two tensioning drums for the purpose of applying tension on the dispensed fencing to be stretched against preset posts for attachment.

Detachable rotating spools are provided on the platform and are capable of carry rolls of woven, welded, chain link and/or barb wire fencing. The entire embodiment is affixed upon a carrying platform that is adaptable to most any type of vehicle.

DETAILED DESCRIPTION OF THE INVENTION

Figure 1:
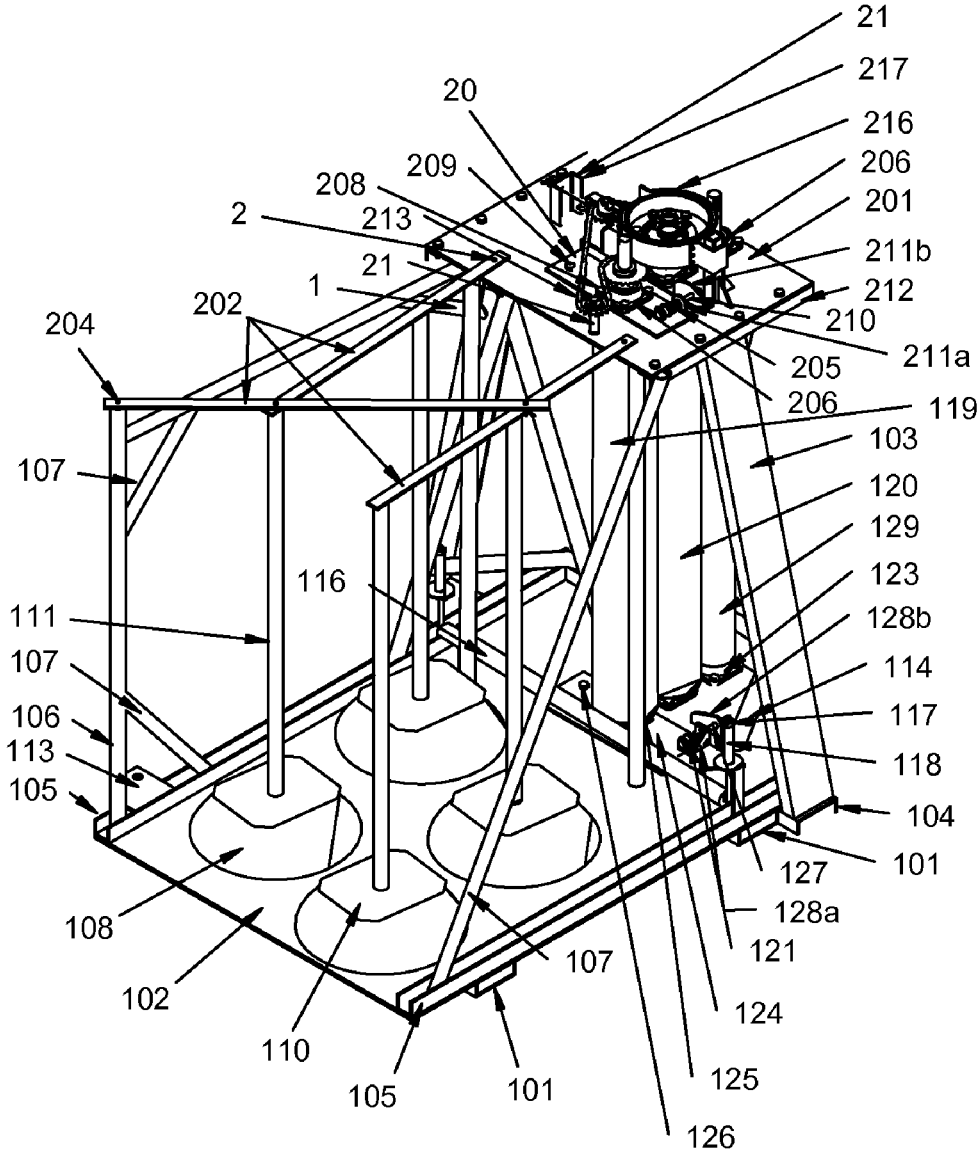
FIG. 1 is a perspective view of an embodiment of the fencing wire dispenser and tensioner in accordance with the invention.

The invention in the illustrations is carried by carrier sleeves 101 to receive pallet fork under lower platform 102. Upper platform 201 is supported by channel supports 103 upstanding from extended support 104 that is attached to base platforms 102. Lower platform supports 105 re-enforce lower platform 102. Vertical frame members 106, upstanding from lower platform supports 105 and braced by angled braces 107 provide anchorage for spool braces 202.

Figure 8:
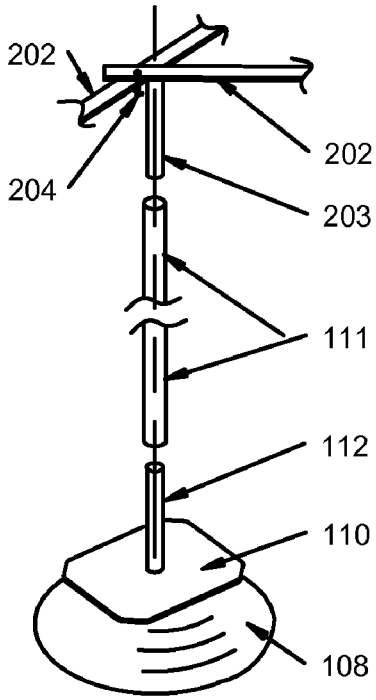
FIG. 8 is an exploded view connection at spool base and spool top connections.

Spool base 108 resting on and secured to lower platform 102 provides appropriate height for fence wire 109 resting on wire support 110. Wire support 110 with attached upstanding wire spool 111 fits over the upstanding spool base shaft 112 FIG. 8 around which it rotates when dispensing fence wire 109.

Figure 2:
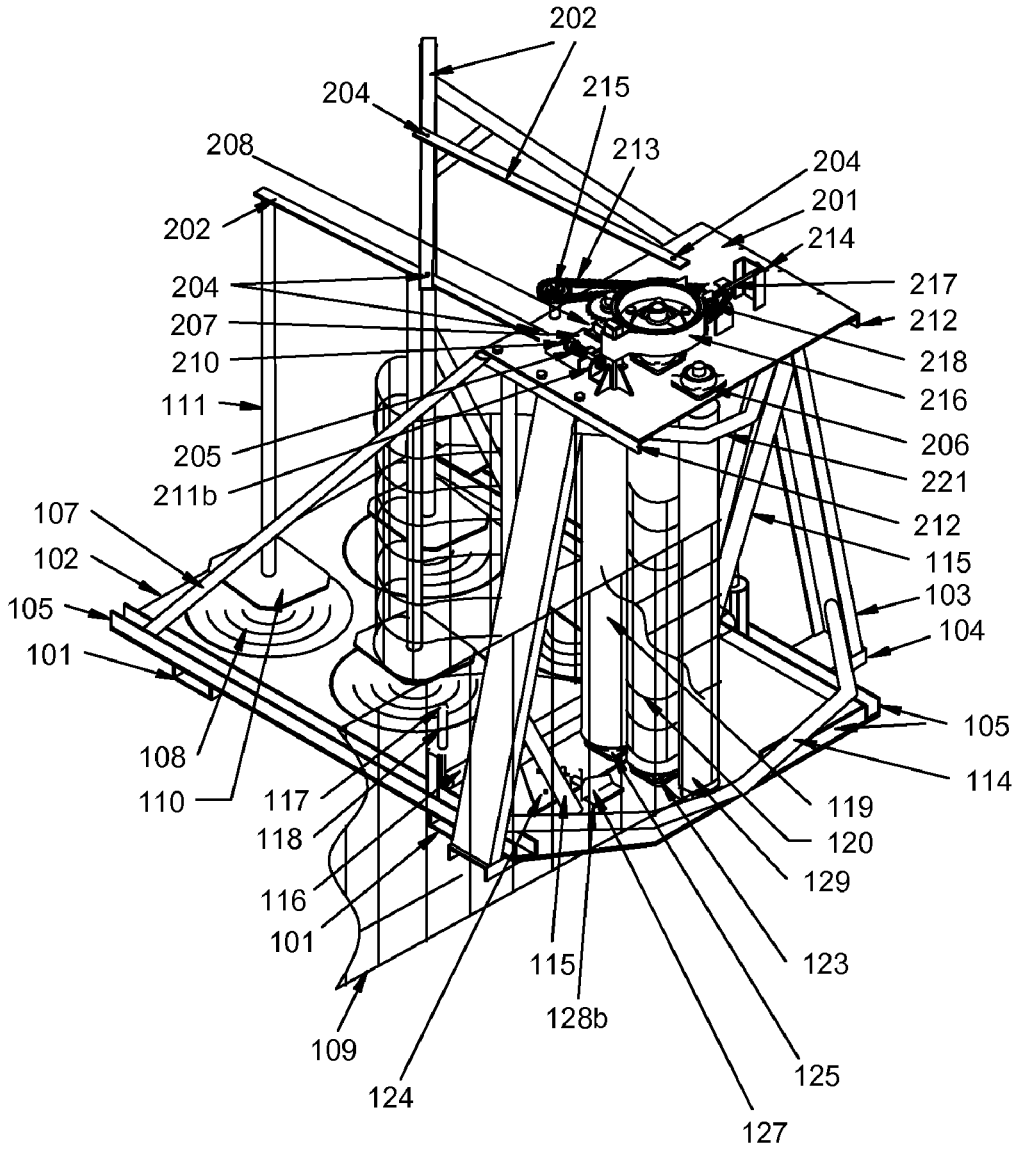
FIG. 2 is another perspective view of the dispensing and tensioning device adapted for woven fence wire only and showing wire loading scheme A.
Figure 3:
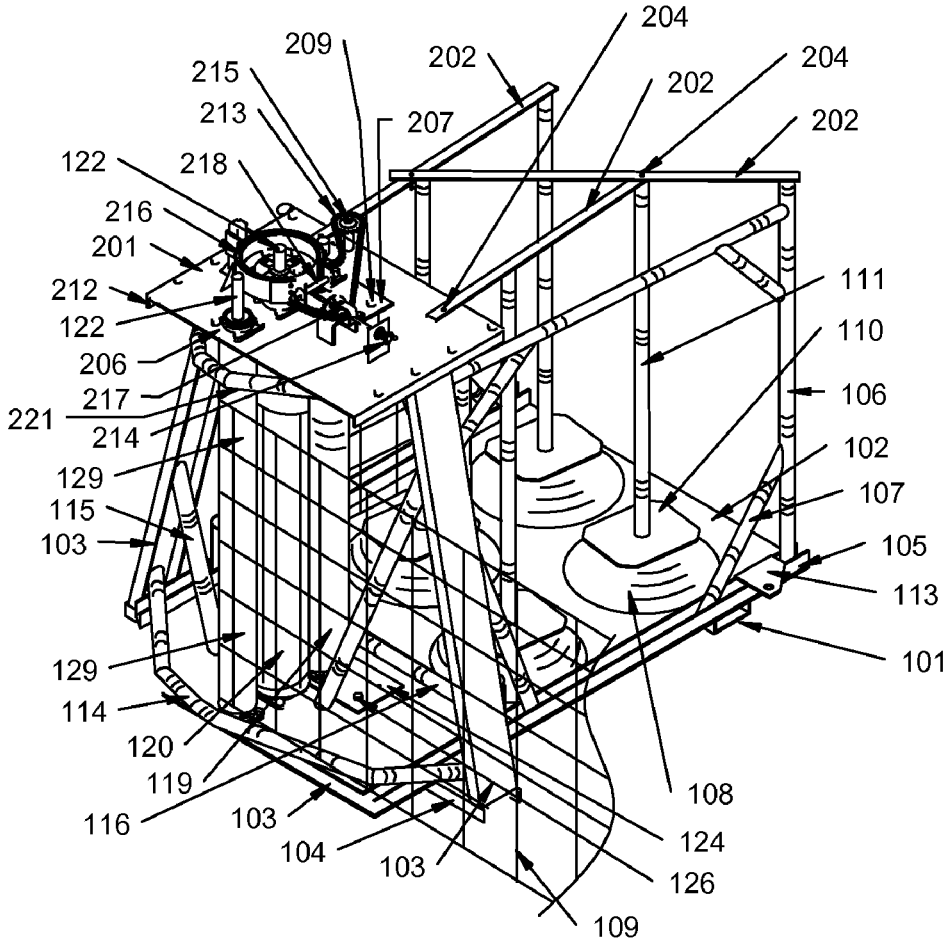
FIG. 3 is an additional perspective view of the dispensing and tensioning device showing woven wire loading scheme B.
Figure 4:
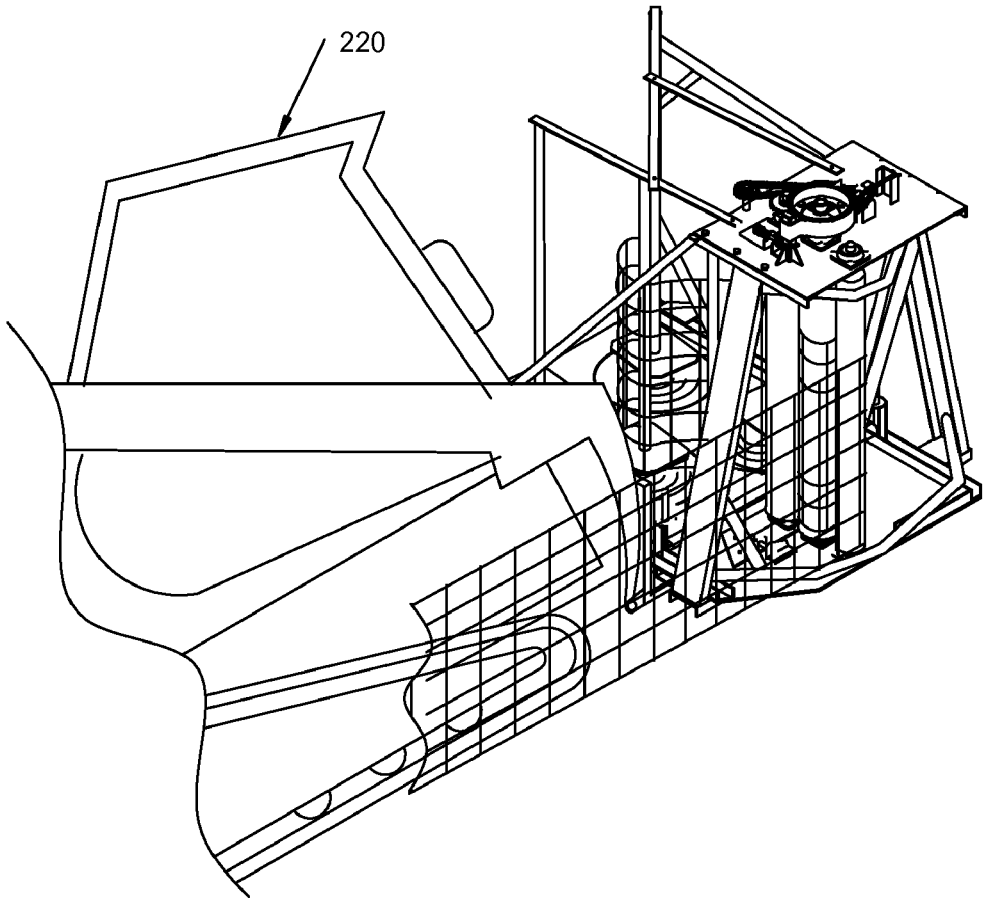
FIG. 4 is a reduced scale perspective view of FIG. 2, partially showing a transporting vehicle 220.
Figure 5:
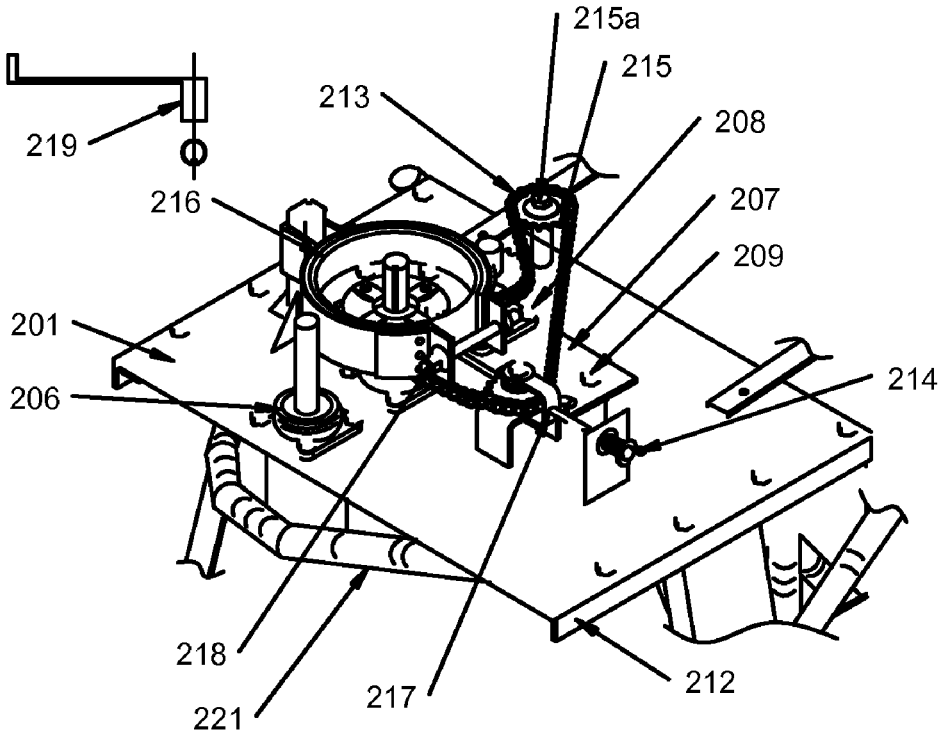
FIG. 5 is a close up perspective view of the brake drum assembly, the chain connecting the roller shafts and the chain tension adjuster.
Figure 6:
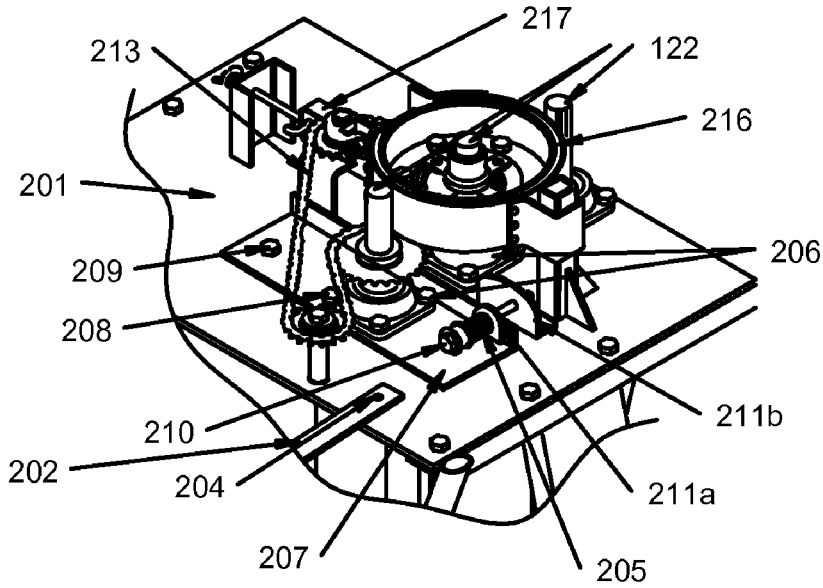
FIG. 6 is a close up perspective view of the upper coil spring and upper bracket a and b mounted on upper pivot plate showing adjustment bolt to set tension on tension drum A.
Figure 7:
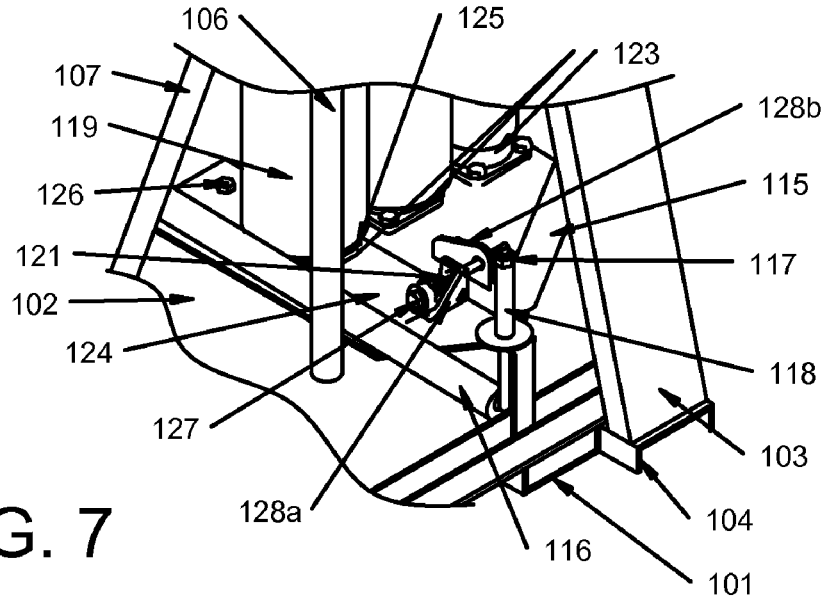
FIG. 7 is a close up perspective view of the lower compression spring and mounted on a plate that swivels to allow adjustment to the tension of the movable compression roller. Depicted in this view is the bolt to adjust the height of the wire height bar.

The top of wire spool 111 is secured in place by spool braces 202. Spool braces 202 are attached to vertical frame members 106 by spool shaft 203 being inserted into top of vertical frame member 106. Spool brace 202 is attached to upper platform 201 by spool brace pin 204 FIG. 8 and where spool braces 202 intersect each other they are also attached by spool brace pin 20. To load the fence wire 109, remove the three spool braces 202 and remove the four wire spools 111. Insert the top of the wire spool into the bottom of the fence wire roll 109. Place the loaded wire spool onto the spool base shaft 112. Replace the three spool braces and install all spool brace pins 204 and spool shafts 203 to secure the wire spool braces 202 to the top of the wire spools 111. Feed the fence wire 109 into the tensioning rollers A 119 and B 120, use tensioning roller tool 219 to turn the tensioning rollers A 119 and B 120 and the wire will feed through the between the tensioning roller A 119 and B 120. Feed the fence wire 109 between each tensioning roller A 119 and B 120 as shown in FIG. 2 or FIG. 3 as determined by the intended direction of travel.

Attachment bracket 113 welded to lower platform support 105 is available to secure invention to vehicle when vehicle 220 is used in reverse direction pulling on invention rather than pushing the invention forward. The attachment bracket 113 is seldom used as invention can be picked up from either side and used in the forward or pushing mode.

The lower wire guide 114 and the upper wire guide 221 are attached to the two channel supports 103 to limit the movement of the wire as it passes from the guide roller 129 toward the fence posts. Bracing members 115 provides bracing for channel supports 103. The height of the wire as it is fed to the tensioning rollers A 119 and B 120 is adjustable by means of the height adjustment bar 116 by turning adjusting nut 117. The adjustment bar 116 is allowed to rotate around end of adjusting bolt 118 if there should be any binding of the fence wire 109.

Constant tension is maintained on the dispensed fence wire 109 by the tensioning roller A 119 against tensioning roller B 120 by lower coil spring 121 at the lower platform 102 and upper coil spring 205 at the upper platform 201. Tensioning roller A 119 is mounted on a roller shaft 122. The lower end of vertical roller shaft 122 at tensioning roller A 119 is mounted in lower bearing assembly 123 and is like wise mounted in upper bearing assembly 206.

Lower bearing assembly 123 is anchored to lower pivot plate 124 by lower stud and nut set 125. Lower pivot plate 124 is held in place by and allowed to pivot around the lower pivot bolt 126 at one end and is anchored by lower spring bolt 127 at the other. Lower spring bolt 127 first passing through lower coil spring 121 and then lower bracket 128*a*, being welded to lower pivot plate 124, then connects to lower bracket 128*b*, being welded to lower platform 102.

Upper bearing assembly 206 is anchored to upper pivot plate 207 by upper stud and nut set 208. Upper pivot plate 207 is held in place by and allowed to pivot around the upper pivot bolt 209 at one end and is anchored by upper spring bolt 210 at the other. Upper spring bolt 210 first passing through upper coil spring 205 and then upper bracket 211*a*, being welded to upper pivot plate 207, then connects to upper bracket 211*b*, being welded to upper platform 201.

Tensioning roller B 120 and guide roller 129 are mounted in a fixed position to lower platform 102 by means of lower bearing assembly 123 and to upper platform 201 by means of upper bearing assembly 206 with said bearing assembly 123 and 206 being bolted to their respective platforms 102 and 201.

Upper platform 201 is bolted to upper platform supports 212 and is supported above the lower platform 102 by welding upper supports 212 to channel supports 103. Upper platform 201 being mounted at a distance above lower platform 102 to allow for passage of fencing wire in between.

Roller chain 213 is supplied to transfer the tension placed on tensioning roller B 120 by the brake drum 216 to tensioning roller A 119. Roller chain 213 is wound on sprocket 215 at tensioning roller A 119, tensioning roller B 120, chain positioner 215 and at the chain tension adjuster 217. The proper tension on the roller chain 213 is adjustable by turning wing nut 214. Chain positioner 215*a* is located in such position as to facilitate the proper winding of the roller chain 213 so tensioning roller A 119 and tensioning roller B 120 turn in opposite directions. Tensioning roller A 119, tensioning roller B 120 and guide roller 129 have a resilient coating for added tension on fencing wire, to prevent damage to fencing materials and prevent wear on tensioning roller A 119, tensioning roller B 120 and guide roller 129.

The tension on brake drum 216 is adjusted to the proper setting with adjusting bolt 218. Care must be taken in making this adjustment as one revolution of the adjusting bolt 218 can make the difference between the perfect tension and preventing the carrying vehicle 220 from being able to move.

What is claimed is:

1. An apparatus for maintaining tension of rolled fencing material during fence installation, the apparatus comprising:

a platform having at least one shaft extending from the platform to receive a spool of fencing material;

a plurality of tensioning rollers extending from the platform and arranged such that the fencing material passes between two adjacent tensioning rollers while contacting both adjacent rollers simultaneously;

a braking mechanism connected with at least one tensioning roller to provide constant tension to the fencing material as the fencing material is dispensed; and wherein at least one tensioning roller is connected with a moveable portion of the platform, and wherein two adjacent portions of the platform are connected with a tensioning device.

2. The apparatus of claim 1, wherein the tensioning device comprises a coil spring.

3. The apparatus of claim 1, wherein the braking mechanism is connected with at least two tensioning rollers.

4. The apparatus of claim 1, wherein the braking mechanism is connected with a plurality of tensioning rollers.

5. The apparatus of claim 1, wherein the braking mechanism comprises a brake drum connected with a roller chain.

6. The apparatus of claim 5, wherein the roller chain passes around sprockets connected with the tensioning rollers.

7. The apparatus of claim 5, further comprising a chain tension adjuster coupled with the chain such that the tension of the chain can be modified.

8. The apparatus of claim 1, further comprising a pallet fork attachment connected with the platform and having a plurality of openings for receiving pallet forks.

9. The apparatus of claim 1, further comprising a coating formed of a resilient material configured to increase friction and prevent damage to the fencing material, the coating covering exterior surfaces of the tensioning rollers.

10. An apparatus for maintaining tension of rolled fencing material during fence installation, the apparatus comprising:

a platform having at least one shaft extending from the platform to receive a spool of fencing material;

a plurality of tensioning rollers extending from the platform and arranged such that the fencing material passes between two adjacent tensioning rollers while contacting both adjacent rollers simultaneously;

a braking mechanism connected with at least one tensioning roller to provide constant tension to the fencing material as the fencing material is dispensed;

wherein the braking mechanism comprises a brake drum connected with a roller chain that passes around sprockets connected with the tensioning rollers.

11. The apparatus of claim 10, wherein the braking mechanism is connected with a plurality of tensioning rollers.

12. The apparatus of claim 10, further comprising a chain tension adjuster coupled with the chain such that the tension of the chain can be modified.

13. The apparatus of claim 10, further comprising a pallet fork attachment connected with the platform and having a plurality of openings for receiving pallet forks.

14. The apparatus of claim 10, further comprising a coating formed of a resilient material configured to increase friction and prevent damage to the fencing material, the coating covering exterior surfaces of the tensioning rollers.

* * * * *